US010124998B2

(12) United States Patent
De Jong

(10) Patent No.: US 10,124,998 B2
(45) Date of Patent: Nov. 13, 2018

(54) LIFTING DEVICE FOR LIFTING A VEHICLE WITH A LOCKING SYSTEM AND LIFTING SYSTEM AND METHOD THEREFOR

(71) Applicant: Stertil B.V., Kootstertille (NL)

(72) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 0 days.

(21) Appl. No.: 15/860,039

(22) Filed: Jan. 2, 2018

(65) Prior Publication Data

US 2018/0186610 A1 Jul. 5, 2018

(30) Foreign Application Priority Data

Jan. 4, 2017 (NL) ..... 2018120

(51) Int. Cl.

| | |
|---|---|
| ***B66F 3/00*** | (2006.01) |
| ***B66F 3/46*** | (2006.01) |
| ***B66F 7/28*** | (2006.01) |
| ***B66F 17/00*** | (2006.01) |

(52) U.S. Cl.

CPC ..... *B66F 3/46* (2013.01); *B66F 7/28* (2013.01); *B66F 17/00* (2013.01); *B66F 2700/05* (2013.01)

(58) Field of Classification Search

CPC ..... B66F 5/00; B66F 5/02; B66F 7/00; B66F 7/04; B66F 7/12

See application file for complete search history.

(56) References Cited

U.S. PATENT DOCUMENTS

| | | | | |
|---|---|---|---|---|
| 4,856,618 | A | 8/1989 | Isogai | |
| 5,484,134 | A * | 1/1996 | Francis | B66F 7/04 254/2 B |
| 6,279,685 | B1 * | 8/2001 | Kogan | B66F 7/20 187/203 |
| 6,382,358 | B1 | 5/2002 | Kritzer | |
| 8,474,793 | B2 * | 7/2013 | Penenburgh | B66F 3/18 254/134 |
| 9,611,128 | B2 * | 4/2017 | Van Houten | B66F 3/46 |
| 9,868,621 | B2 * | 1/2018 | Jaipaul | B66F 3/46 |
| 2006/0182563 | A1 | 8/2006 | De Jong et al. | |
| 2011/0037041 | A1 * | 2/2011 | DeJong | B66F 3/46 254/89 R |

(Continued)

FOREIGN PATENT DOCUMENTS

DE 202007014662 U1 12/2007

*Primary Examiner* — Lee D Wilson

(74) *Attorney, Agent, or Firm* — The Webb Law Firm

(57) ABSTRACT

The present invention relates to a lifting system for lifting a vehicle and method therefor. The lifting system according to the invention includes a frame with a moveable carrier configured for carrying the vehicle, with the carrier including a carrying part and a guiding part; a drive which acts on the carrier and is configured for raising and/or lowering the carrier relative to the frame; a locking system for locking and unlocking the moveable carrier relative to the frame; and a controller configured for controlling the height of the carrier. The locking system includes a lock actuator, a locking rail, a locking drive configured for moving the lock actuator between a locked state and an unlocked state, and a lock and is configured for engaging and/or disengaging the locking rail in response to a movement of the lock actuator.

20 Claims, 4 Drawing Sheets

(56) References Cited

U.S. PATENT DOCUMENTS

| | | | | |
|---|---|---|---|---|
| 2013/0233651 | A1* | 9/2013 | Kritzer | B66F 7/20 187/208 |
| 2013/0240812 | A1 | 9/2013 | Helmich | |
| 2015/0232310 | A1* | 8/2015 | Jaipaul | B66F 3/46 414/800 |
| 2016/0016768 | A1 | 1/2016 | Karleskint et al. | |
| 2016/0052757 | A1 | 2/2016 | De Jong | |
| 2016/0145085 | A1* | 5/2016 | Benz | B66F 7/025 254/134 |

* cited by examiner

LIFTING DEVICE FOR LIFTING A VEHICLE WITH A LOCKING SYSTEM AND LIFTING SYSTEM AND METHOD THEREFOR

CROSS-REFERENCE TO RELATED APPLICATION

This application claims priority to Dutch Patent Application No. 2018120 filed Jan. 4, 2017, the disclosure of which is hereby incorporated in its entirety by reference.

FIELD

The invention relates to a lifting device for lifting a vehicle such as passenger cars, trucks, busses and other vehicles, and more specifically a mobile lifting column such as a wireless mobile lifting column.

BACKGROUND

Lifting devices including lifting columns are known from practice and comprise a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. Such prior art lifting device is disclosed in U.S. Patent Application Publication No. 2006/0182563, which is incorporated herein by reference. When the vehicle is lifted and is at a desired height the carrier is locked to provide a safe working environment. This is achieved with a locking system.

Conventional locking systems of lifting devices require a number of parts and a considerable weight. This renders operation with the lifting systems rather difficult and/or adds to the manufacturing and transportation costs of the lifting devices.

An object of the present invention is to obviate or at least reduce the aforementioned problems associated with conventional lifting devices.

SUMMARY

This object is achieved with the lifting device for lifting a vehicle, such as a passenger car, truck, bus or other vehicle, with the lifting device comprising:

- a frame with a moveable carrier configured for carrying the vehicle, wherein the carrier comprises a carrying part and a guiding part;
- a drive which acts on the carrier and configured for raising and/or lowering the carrier relative to the frame;
- a locking system for locking and unlocking the moveable carrier relative to the frame; and
- a controller configured for controlling the height of the carrier, wherein the locking system comprises:

- a lock actuator and a locking rail that both extend over at least a part of the height of the frame;
- a locking drive configured for moving the lock actuator between a locked state and an unlocked state; and
- a lock that is provided at or on the moveable carrier and is configured for engaging and/or disengaging the locking rail in response to a movement of the lock actuator.

The carrier of the lifting device is capable of carrying the vehicle that needs to be lifted. In a presently preferred embodiment the carrier moves upward and/or downward relative to the frame of the lifting column with the use of a drive. The carrier comprises a carrying part that is configured for carrying a vehicle, or at least a part thereof. The carrier further comprises a guiding part that enables a guiding movement relative to the frame of the lifting device. In a presently preferred embodiment, the drive comprises a hydraulic cylinder drive unit that is configured for raising the carrier. This unit comprises a housing, a cylinder with a piston rod that is movable in the housing of the cylinder, and corresponding parts of such hydraulic system. Alternatively, another drive system can be used, for example a pneumatic and/or electrical drive system. In one of the presently preferred embodiments the unit is embodied as an integrated hydraulic cylinder drive unit as disclosed in U.S. Patent Application Publication No. 2016/0052757 which is incorporated herein by reference.

The lifting device further comprises a controller that is configured for controlling the height of the carrier. The controller can be provided at or in the frame of the lifting device and/or may relate to a central controller capable of controlling a number of lifting devices and/or several groups of lifting devices, or any mixture thereof. Preferably, the controller also comprises a display and optionally other user input and output devices to enable communication with the user. The controller is preferably capable of receiving a measurement from one or more sensors or sensor systems that indicate one or more of a height of the carrier, height difference of the carrier, moving speed of the carrier, and information about the control actions directed towards the drive, such as the amount of hydraulic oil sent to the drive for raising or lowering the carrier relative to the frame.

The locking system of the lifting device of the present invention comprises a lock activator and a locking rail. Both extend over at least a part of the height of the frame. The locking system further comprises a locking drive configured for moving the lock actuator between a locked state and an unlocked state, and a lock that is provided at or on the moveable carrier and is configured for engaging and/or disengaging the locking rail in response to the movement of the actuator. Preferably, the lock is provided at the guiding part of the moveable carrier.

Providing the lock at the carrier enables a reduction of the height of the guiding part of the carrier. This significantly reduces the amount of material that is required for the carrier. Therefore, the overall weight of the carrier is significantly reduced without influencing the performance of the lifting device. This reduces manufacturing costs, improves operational efficiency when working with the lifting device of the present invention, and may also reduce transportation costs.

As a further advantage of the locking system according to the present invention, the carrier can be locked at any desired position along the frame of the lifting device. This significantly reduces the locking pitch that is present in conventional lifting devices. It also contributes to a safe and user friendly operation of the lifting device in one of the embodiments of the present invention.

In a presently preferred embodiment of the invention the lock preferably comprises a pawl, lock, block, pen or rod-like element that moves to and from the locking rail that is attached or provided in the frame when engaging or disengaging the carrier. Preferably, the locking rail comprises a number of teeth shaped like a gear rack that extends over a substantial part of the height of the frame.

Activating the lock with a lock actuator and a locking drive that are configured for moving the lock actuator between a locked state and an unlocked state enables the lock to engage or disengage the locking rail. The lock actuator preferably extends over a substantial part of the height of the frame, wherein the height of the frame preferably substantially corresponds to the height of the locking rail. The use of the lock actuator has the advantage that no communication cables or power supply needs to be provided to the moveable carrier. By obviating the need for providing such cables or connections a robust lifting device is achieved.

In a presently preferred embodiment of the invention the lock actuator is embodied as a strip or rod or rail or vane that is configured for steering the lock. In such embodiment this mechanical lock actuator provides a reliable and robust locking system that can be manufactured at relatively low cost.

In one of the presently preferred embodiments of the invention the lock actuator is configured such that the locking system moves to the locked state in case of a power failure, for example a hydraulic, pneumatic or electric power failure. This improves the overall safety when working with the lifting device of the invention.

The lock actuator and locking rail are preferably provided in or at the frame. This reduces fouling and the risk of damaging these parts during operation of the lifting device. This guarantees a robust and effective operation of the locking system. Also, in one of the preferred embodiments of the invention the locking actuator is provided in a frame with a connection such that the locking actuator may rotate around its axis when moving between the locked and unlocked state. Such rotational movement enables an effective control of the lock.

In a presently preferred embodiment of the invention the lock comprises a locking mechanism that further comprises a rod extending between the lock and the carrier.

Providing a locking mechanism enables an effective operation of the lock. Optionally, the rod enables manual control of the locking system. For example, this enables manual disengagement of the lock from the locking rail, also in case of a power failure.

Preferably, the rod is connected to the carrier with a hinged connection and substantially extends in a vertical direction. Even more preferably, the hinged connection is configured such that it automatically moves the lock in the locked state when the actuator is not activated. This achieves a safe working environment when working with the lifting device that is also safe in case of a power failure, as was described earlier in this description.

In a further preferred embodiment of the invention the locking actuator comprises a locking frame and an anti-wear strip extending over substantially the length of the locking actuator.

Providing the locking actuator with a locking frame and an anti-wear strip prevents or at least reduces wear of the lock actuator when the pawl or locking element of the lock moves along the lock actuator. This reduces wear and reduces the risk of malfunctioning of the lifting device.

Preferably, the locking frame comprises a light-weight material, more preferably aluminium. This further improves the overall weight of the locking system and the lifting device provided therewith. Furthermore, the anti-wear strip comprises polyethylene or a similar wear-reducing material.

In one of the presently preferred embodiments of the invention the ratio of the length of the guiding part of the carrier and the length of the frame of the lifting device is below 0.5, preferably below 0.4, and most preferably below 0.3.

While in conventional lifting columns the length of the guiding part of the carrier is more or less similar to the height (also referred to as frame length) of the frame, the use of the locking system according to the present invention enables a reduction in the length of the guiding part of the carrier. This length of the guiding part can be significantly smaller than the length of the frame. Most preferably, the length of the guiding part of the carrier is below 0.3 of the length (also referred to as height) of the frame. This significantly reduces the amount of material required for the guiding part and, therefore, the overall weight of the lifting device.

Lifting devices according to the invention include lifting columns of the two-post lift type with pivoting support arms, the four-post lift type with runways, the wired or wireless mobile type lifting columns, in-ground lifts etc.

In one of the presently preferred embodiments of the invention the lifting device relates to a lifting column and more preferably to a mobile lifting column. Especially the weight reduction of the locking system of the invention significantly improves the efficiency of working with such mobile lifting column.

The present invention also relates to a lifting system comprising one or more of the aforementioned lifting devices, more preferably comprising one or more lifting columns, and most preferably one or more mobile lifting columns.

The lifting system provides the same effects and advantages as those stated for the lifting device. It is noted that the lifting device may relate to any of the embodiments according to the present invention. For example, the lifting system may comprise a number of (mobile) lifting columns acting as lifting device. The individual lifting devices/columns can be controlled by a central controller of the lifting system, for example.

Preferably, a number of lifting devices, more specifically a number of (mobile) lifting columns can be grouped together as a lifting system. In an embodiment of such a lifting system according to the invention, when lifting a vehicle, at least two lifting columns are being used. In fact, in practice often four lifting columns are being used. During such lifting operation, the timing of these separate lifting columns including the moving speed of the carrier that carries (part of) the vehicle when lifting a vehicle, requires synchronization. The control of the lifting system preferably comprises a system controller that synchronizes the height of the separate carriers in the ascent mode using, for example, a measurement signal generated by a height sensor, for example a potentiometer. Of course, other sensors can also be used.

In case one of the carriers has moved too fast in the ascent mode and is too high as compared to the other carriers of the other lifting columns, for example the power supply to this carrier is either directly or indirectly lowered so that the other carriers can catch up or, alternatively, the power supply to the other carriers is either directly or indirectly increased so that the other carriers can catch up. In the descent mode, it is also important that the height of the carriers between the several lifting columns is synchronized. Therefore, in case one of these carriers has moved too slowly, for example its power supply is increased in order for this carrier to catch up with the other carriers or, alternatively, the power supply to the other carriers is either directly or indirectly lowered so that the other carriers can catch up.

The present invention also relates to a method for lifting a vehicle, the method comprising the steps of:

providing a lifting device or lifting system according to one or more of the embodiments of the present invention;

lifting the vehicle with the drive acting on the carrier; and locking the carrier at a certain height relative to the frame by:

actuating the lock actuator;

moving the lock with the locking drive between a locked state and an unlocked state; and engaging or disengaging the lock from the locking rail in response to a movement of the lock actuator.

The method provides the same effects and advantages as those stated for the lifting device and/or lifting system. It is noted that the lifting device may relate to any of the embodiments according to the present invention. The individual lifting devices or lifting columns can be controlled by a central controller of the lifting system, for example. This further improves the accuracy and safety of the lifting system.

In one of the presently preferred embodiments of the invention the locking system of the lifting device moves to the locked state in case of a power failure, for example a hydraulic, pneumatic and/or electric power failure. This achieves a safety measure when working with the lifting device in one of the embodiments of the invention.

BRIEF DESCRIPTION OF THE DRAWINGS

Exemplary embodiments of a lifting system and/or the method according to the present invention are described here below on the basis of a non-limitative exemplary embodiment therefor shown in the accompanying drawings, wherein.

DETAILED DESCRIPTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The lift control system of the present invention is suitable for use with lift systems comprising any number of lifting devices that require height control columns, including systems having one, two, four or another number of columns. The columns may achieve lifting and lowering capability by any means known to those of skill in the art, including hydraulically, electrically, mechanically, and electromechanically. Lift systems compatible with the present lift control system may involve wired and/or wireless communication. With reference to the figures, like element numbers refer to the same element between drawings.

Figure 1:
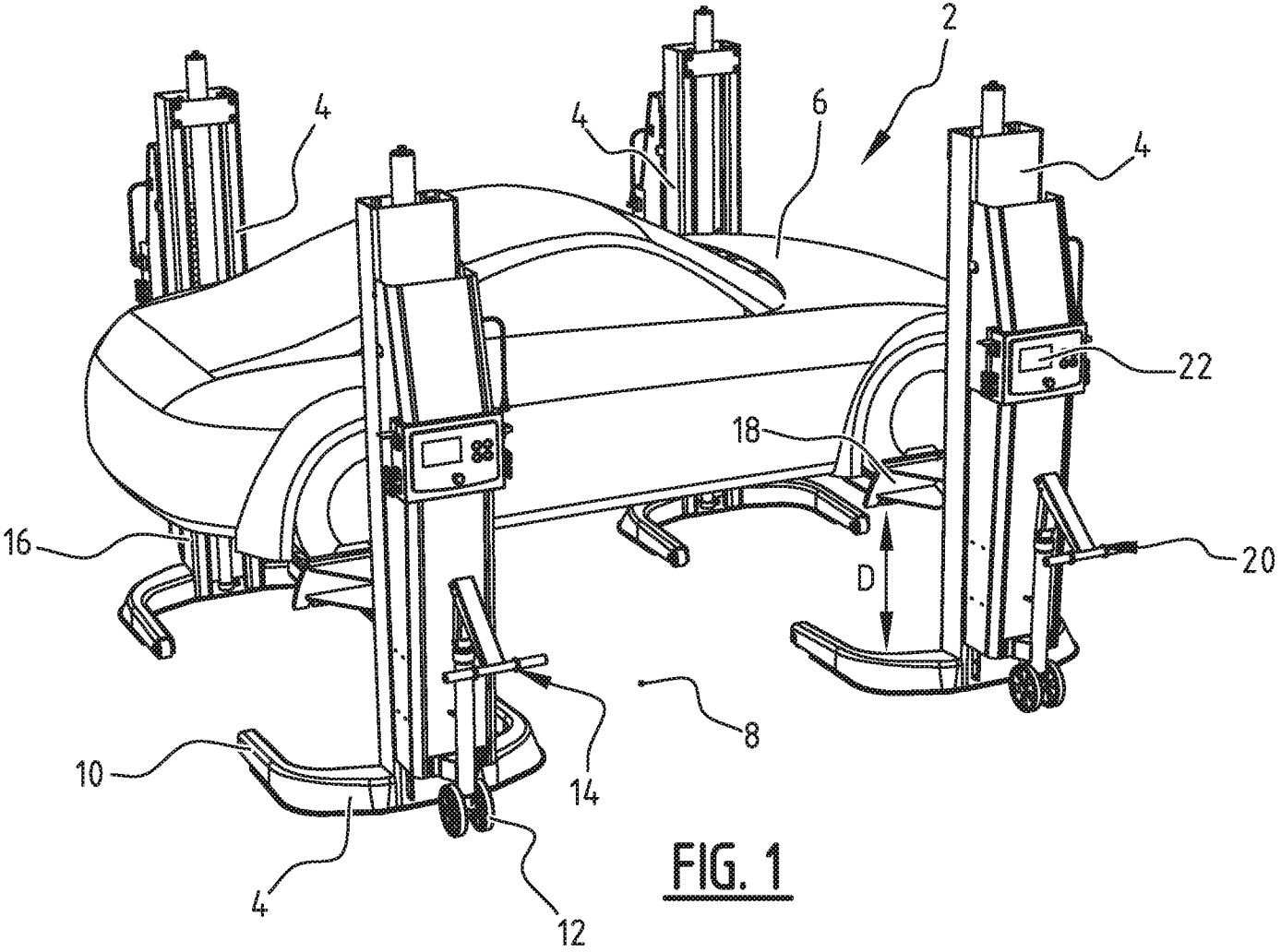
FIG. 1 shows a lifting system comprising a number of mobile lifting columns according to the present invention.
Figure 2:
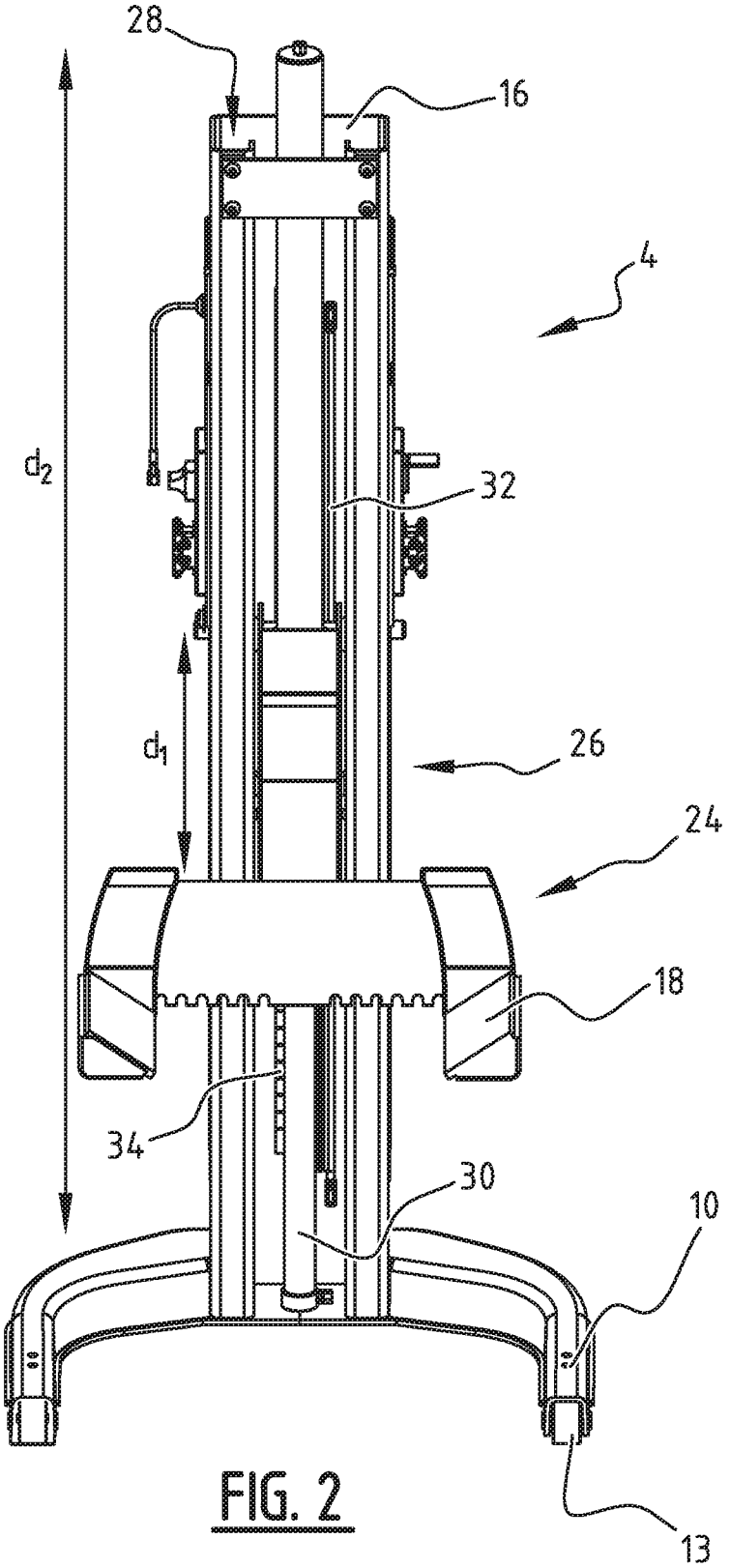
FIG. 2 shows a mobile lifting column of the type shown in FIG. 1 with a locking system.

System 2 for efficient lifting and lowering load 6 (FIG. 1) comprises four wireless mobile lifting columns 4. Lifting columns 4 lift passenger car 6 from ground 8. In the illustrated embodiment lifting columns 4 are connected to each other and/or a control system by wireless communication means or alternatively by cables. Lifting columns 4 comprise foot 10 which can travel on running wheels 12 over ground surface 8 of for instance a floor of a garage or workshop. In the forks of foot 10 is provided an additional running wheel 13 (FIG. 2). Running wheel 12 is part of pallet truck mechanism 14 enabling easy manoeuvring of lifting column 4. Lifting column 4 furthermore comprises mast 16. Carrier 18 is moveable upward and downward along mast 16. Optionally, adapters can be used to adjust carrier 18 to specific wheel dimensions. Carrier 18 is driven by motor/drive system 20 that is preferably provided in a housing of lifting column 4. System 20 is supplied with power from the electrical grid or by a battery that is provided on lifting column 4 in the same housing as system 20, or alternatively on foot 10 (not shown), for example. Lifting column 4 is provided with control panel 22 to allow the user of system 2 to control the system, for example by setting the speed for carrier 18. In one embodiment, the motor of system 20 is a 3-phase low voltage motor controlled by a separate controller. In another embodiment, the motor of system 20 is a 3-phase low voltage motor with integrated controller. Such motor with integrated controller can also be used in combination with conventional lifting devices with conventional height measurement systems.

Each of the lifting columns has at least one ascent mode and one descent mode, and is under the influence of integrated controller with control panel 22. Controller 22 can be designed for each lifting column 4 individually, or for the lifting columns 4 together. A pressure or load sensor may be used for monitoring, control and indication of the correct positioning of the load that is lifted with lifting system 2.

Carrier 18 (FIG. 2) comprises carrying part 24 and guiding part 26. Guiding part 26 extends over length $d_1$ along guide rail 28 in a substantial vertical direction. Guide rail 28 is provided with cylinder 30. Guide rail 28 extends over length $d_2$ along mast 16. It is noted that this length $d_2$ is mostly related to the length or height of cylinder 30. Mast 16 also houses locking system 32 and locking rail 34. In the illustrated embodiment locking rail 34 extends over a substantial part of the length or height of mast 16.

Figure 3:
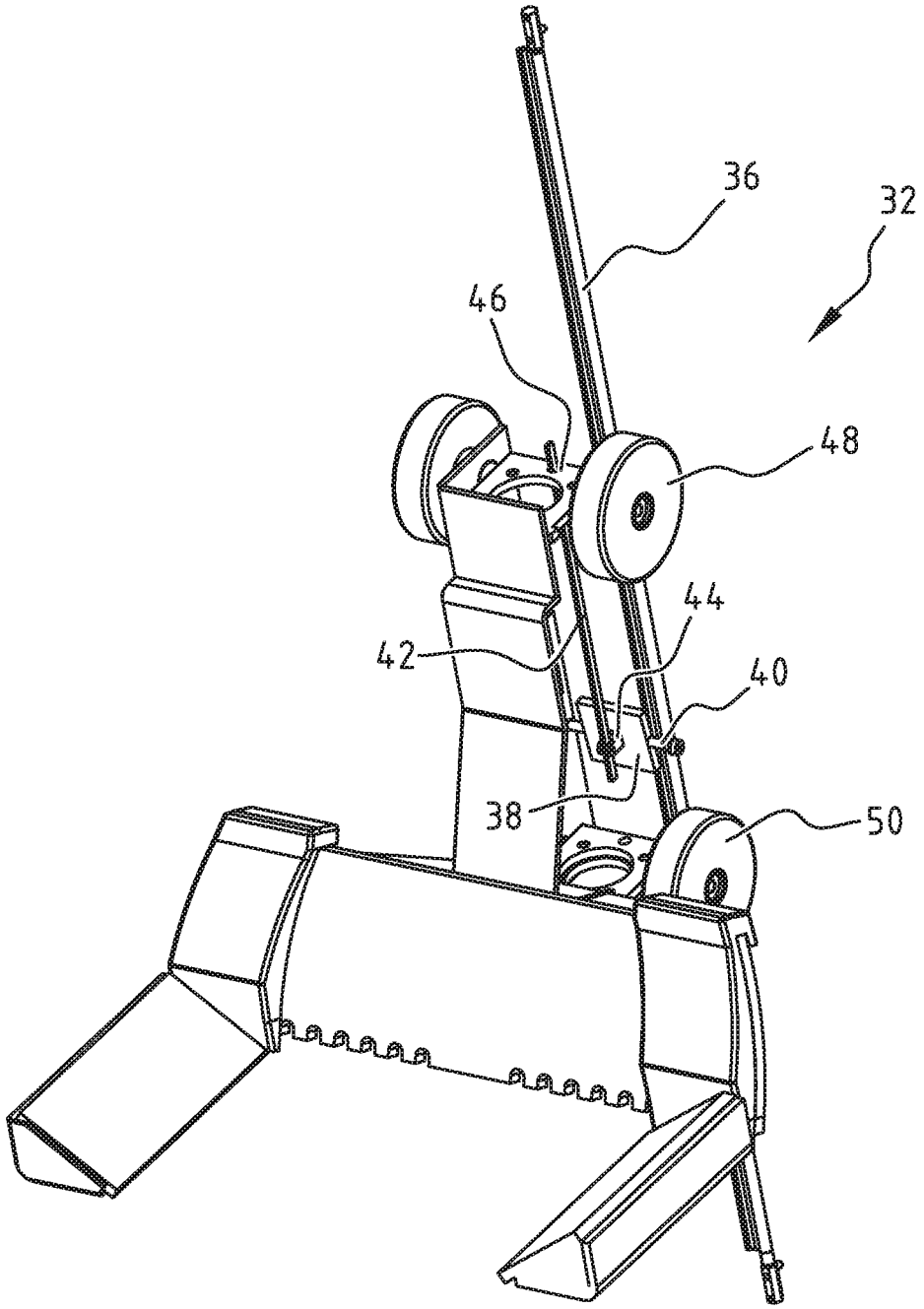
FIG. 3 shows the carrier and locking system of the mobile lifting column of FIG. 2.

Locking system 32 (FIG. 3) comprises lock actuator 36 that extends over a substantial part of the length or height of mast 16. Lock 38 comprises a block/blocking element capable of engaging with locking rail 34, and optionally a pawl with pen 40. Lock 38 is provided at one end of rod 42. Rod 42 is connected to lock or block 38 with connection 44. Furthermore, rod 42 is connected to guiding part 26 of carrier 18 at upper connection 46. Carrier 18 moves along mast 16 with upper guide wheels 48 and lower guide wheels 50.

Figure 4:
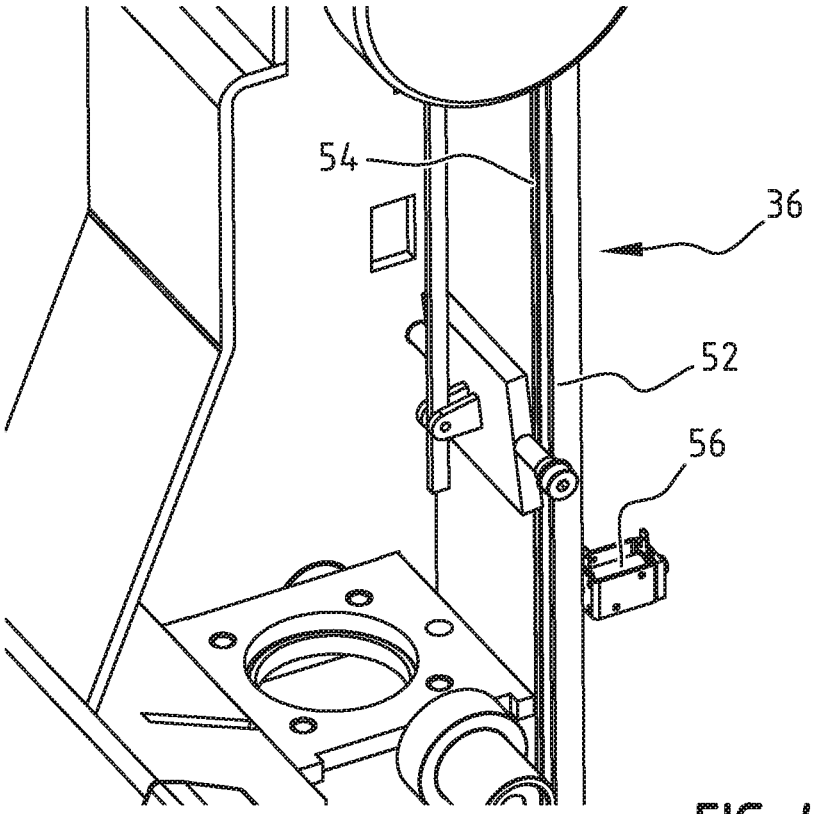
FIG. 4 shows a detail of the lock actuator and locking drive of the locking system of FIG. 3.

Lock actuator 36 (FIG. 4) comprises aluminium profile or frame 52 and polyethylene anti-wear strip 54 that may contact block 38. In the illustrated embodiment lock actuator 56 comprises an electromagnet.

Figure 5:
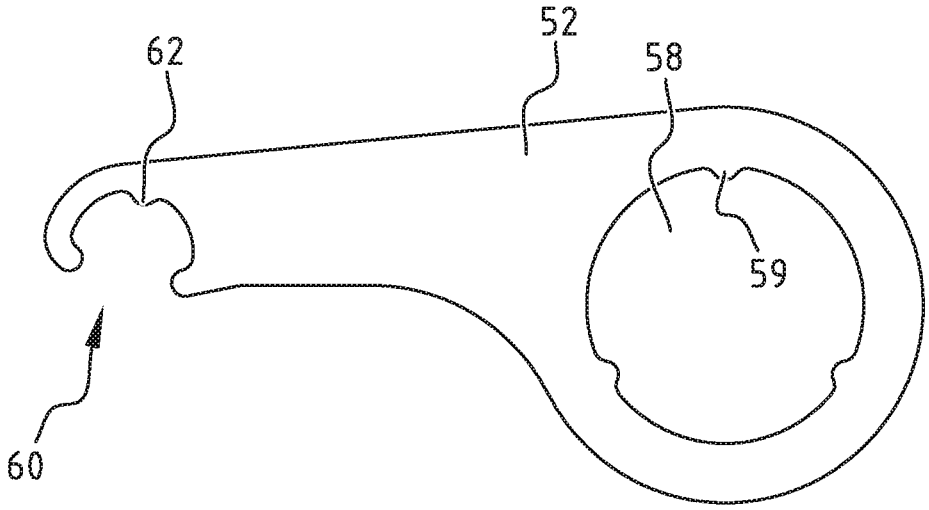
FIG. 5 shows details of the lock actuator shown in FIGS. 3 and 4.

Profile 52 (FIG. 5) comprises hole or opening 58 with a number of protrusions or nocks 59. The other end profile frame 52 is provided with hole or opening 60 having a number of protrusions or nocks 62, with hole 60 capable of receiving PE strip 54.

When lifting car 6 a number of mobile lifting columns 4 are positioned around vehicle 6. When the lifting operation is approved carriers 18 start moving along masts 16. As soon as the desired height D above ground surface 8 of carriers 18 is reached a locking system 32 is activated. Locking system 32 activates lock actuator 56 to rotate lock actuator 36, with lock actuator 36 comprising profile 52 and anti-wear strip 54. Lock actuator 36 is pivotally connected at its outer ends to mast 16 or other parts of the lifting device. When rotating lock actuator 36 block or pawl 38 will engage or disengage from locking rail 34. Rail 34 preferably extends along mast 16. As a further advantage, as the length of lock actuator 36 corresponds to the length of stroke of cylinder 30 carrier 18 can be locked at any desired height along mast 16. This further improves the operation of lifting device of the present invention.

Preferably, in case of a power failure, the electromagnet of lock actuator 56 is turned off and profile 52 returns to its inactive position wherein block 38 engages locking rail 34. Optionally, a user may manually operate rod 42 to disengage block 38 from locking rail 34 to lower carriers 16, for example. This contributes to providing a safe working environment with an effective lifting device.

The present invention is by no means limited to the above described preferred embodiments. The rights sought are defined by the following claims within the scope of which many modifications can be envisaged. For example, the present invention can be applied to the (wireless) lifting columns illustrated in FIG. 1. Alternatively the invention can also be applied to other types of lifting columns and lifting systems.

What is claimed is:

1. A lifting device for lifting a vehicle, the device comprising:

a frame with a moveable carrier configured for carrying the vehicle, wherein the carrier comprises a carrying part and a guiding part;

a drive which acts on the carrier and configured for at least one of raising and lowering the carrier relative to the frame;

a locking system for locking and unlocking the moveable carrier relative to the frame; and a controller configured for controlling the height of the carrier, wherein the locking system comprises:

a lock actuator and a locking rail that both extend over at least a part of the height of the frame;

a locking drive configured for moving the lock actuator between a locked state and an unlocked state; and a lock that is provided at or on the moveable carrier and is configured for at least one of engaging and disengaging the locking rail in response to a movement of the lock actuator.

2. The lifting device according to claim 1, wherein the lock actuator and the locking rail are provided in or at the frame.

3. The lifting device according to claim 2, wherein the locking actuator is provided in the frame with a connection such that the locking actuator may rotate around its axis when moving between the locked and unlocked states.

4. The lifting device according to claim 1, wherein the locking system comprises a locking mechanism that further comprises a rod extending between the lock and the carrier.

5. The lifting device according to claim 4, wherein the rod is connected to the carrier with a hinged connection and substantially extends in a vertical direction.

6. The lifting device according to claim 5, wherein the hinged connection is configured to automatically move the lock in the locked state when the lock actuator is not activated.

7. The lifting device according to claim 1, wherein the locking actuator comprises a locking frame and an anti-wear strip extending over substantially the length of the locking actuator.

8. The lifting device according to claim 7, wherein the locking frame comprises a lightweight material.

9. The lifting device according to claim 7, wherein the anti-wear strip comprises polyethylene.

10. The lifting device according to claim 1, wherein the ratio of the length of the guiding part of the carrier and the length of the frame is below 1.

11. The lifting device according to claim 1, wherein the lifting device comprises a mobile lifting column.

12. The lifting device according to claim 3, wherein the locking system comprises a locking mechanism that further comprises a rod extending between the lock and the carrier.

13. The lifting device according to claim 12, wherein the rod is connected to the carrier with a hinged connection and substantially extends in a vertical direction.

14. The lifting device according to claim 13, wherein the hinged connection is configured to automatically move the lock in the locked state when the lock actuator is not activated.

15. The lifting device according to claim 14, wherein the locking actuator comprises a locking frame and an anti-wear strip extending over substantially the length of the locking actuator.

16. The lifting device according to claim 15, wherein the ratio of the length of the guiding part of the carrier and the length of the frame is below 1.

17. A lifting system comprising at least one group of two or more lifting devices for lifting a vehicle, the lifting device comprising:

a frame with a moveable carrier configured for carrying the vehicle, wherein the carrier comprises a carrying part and a guiding part;

a drive which acts on the carrier and configured for at least one of raising and lowering the carrier relative to the frame;

a locking system for locking and unlocking the moveable carrier relative to the frame; and a controller configured for controlling the height of the carrier, wherein the locking system comprises:

a lock actuator and a locking rail that both extend over at least a part of the height of the frame;

a locking drive configured for moving the lock actuator between a locked state and an unlocked state; and a lock that is provided at or on the moveable carrier and is configured for at least one of engaging and disengaging the locking rail in response to a movement of the lock actuator.

18. The lifting system according to claim 17, wherein the ratio of the length of the guiding part of the carrier and the length of the frame is below 1.

19. A method for lifting a vehicle, the method comprising the steps of:

providing a lifting device or lifting system comprising at least one group of two or more of such lifting devices, with the lifting device comprising:

a frame with a moveable carrier configured for carrying the vehicle, wherein the carrier comprises a carrying part and a guiding part;

a drive which acts on the carrier and configured for at least one of raising and lowering the carrier relative to the frame;

a locking system for locking and unlocking the moveable carrier relative to the frame; and a controller configured for controlling the height of the carrier, wherein the locking system comprises:

a lock actuator and a locking rail that both extend over at least a part of the height of the frame;

a locking drive configured for moving the lock actuator between a locked state and an unlocked state; and a lock that is provided at or on the moveable carrier and is configured for at least one of engaging and disengaging the locking rail in response to a movement of the lock actuator;

lifting the vehicle with the drive acting on the carrier; and locking the carrier at a certain height relative to the frame by:

actuating the lock actuator;

moving the lock with the locking drive between a locked state and an unlocked state; and engaging or disengaging the lock from the locking rail in response to a movement of the lock actuator.

20. The method according to claim 19, wherein the locking system moves to the locked state in case of a power failure.

* * * * *